US005643165A

United States Patent [19]

Klekamp

[11] Patent Number: 5,643,165

[45] Date of Patent: Jul. 1, 1997

[54] FRUSTROCONICAL EXERCISING DEVICE

[76] Inventor: Thomas A. Klekamp, 302 Dean Cir., Bolingbrook, Ill. 60440

[21] Appl. No.: 599,039

[22] Filed: Feb. 9, 1996

[51] Int. Cl.[6] ..... A63B 22/16

[52] U.S. Cl. ..... 482/146; 482/907; 482/91

[58] Field of Search ..... 482/146, 131, 482/91, 907, 79

[56] References Cited

U.S. PATENT DOCUMENTS 3,586,321 6/1971 Gehrke ..... 482/146

4,613,131 9/1986 Anderson ..... 482/146

*Primary Examiner*—Lynne A. Reichard

[57] ABSTRACT

The present invention relates to a saucer which is adapted to be used in exercising various muscle groups. The saucer includes a frustroconical base having a lower end of a first diameter and an upper end of an enlarged diameter. A number of straps are employed on the upper surface of the frustroconical base for use in securing a user thereon. Thus, with a user secured to the upper surface of the frustroconical base, they may shift their weight in such a manner that the device no longer rests on the lower surface of the base, and thus rests upon the tapered sidewall. The user can then commence various exercising routines in an effort to exercise difficult to reach muscle groups.

1 Claim, 3 Drawing Sheets

FIG 1
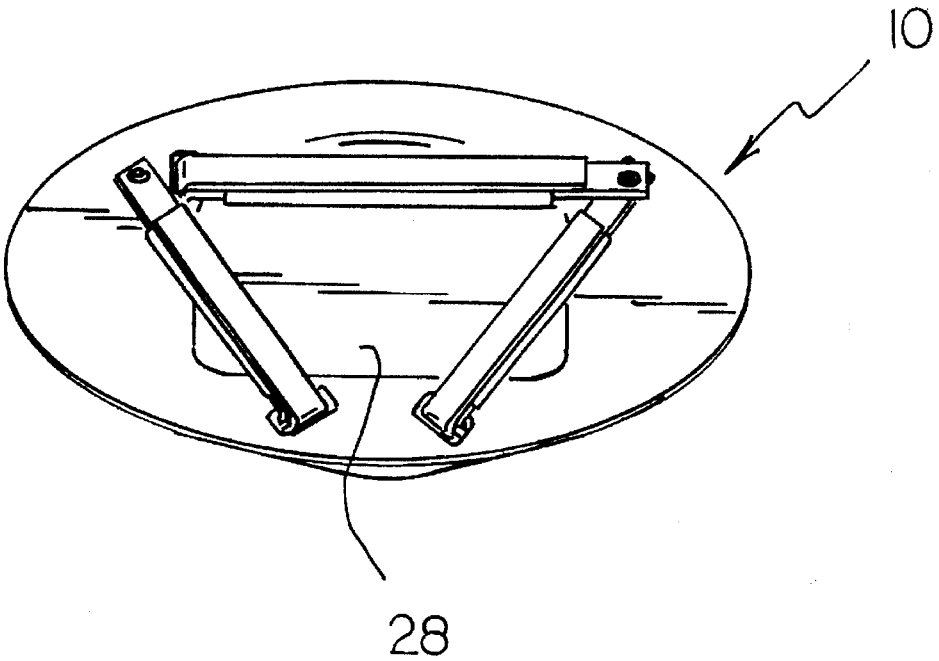
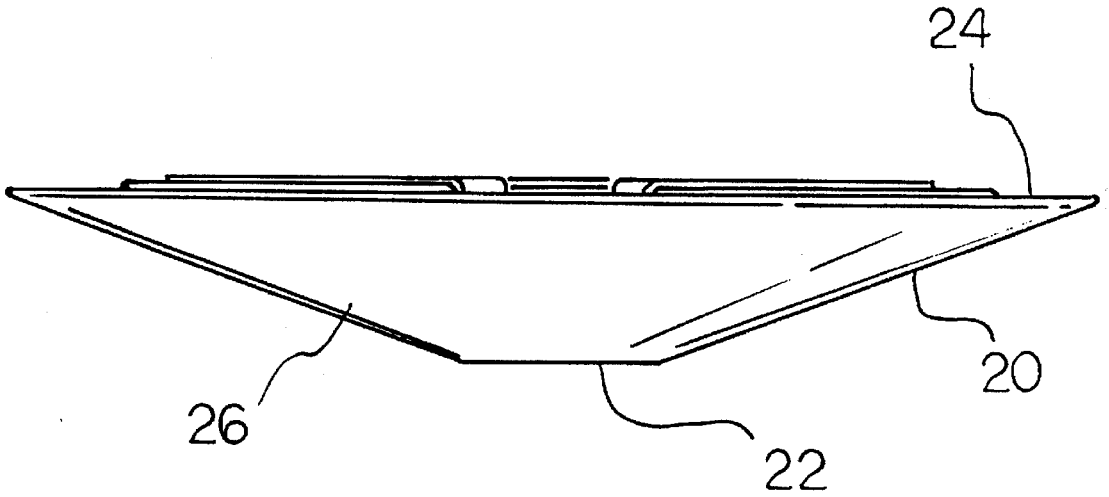
FIG 2

FIG 5
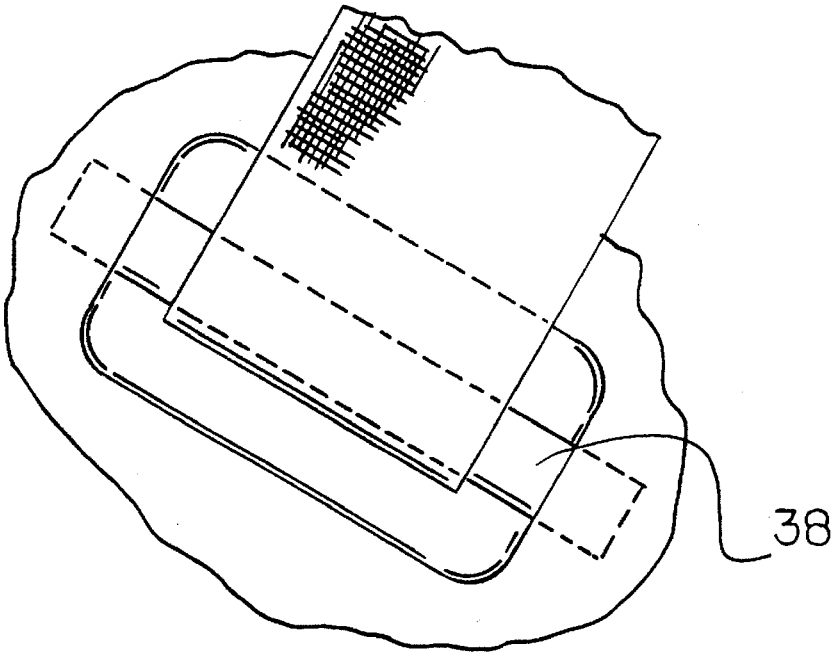
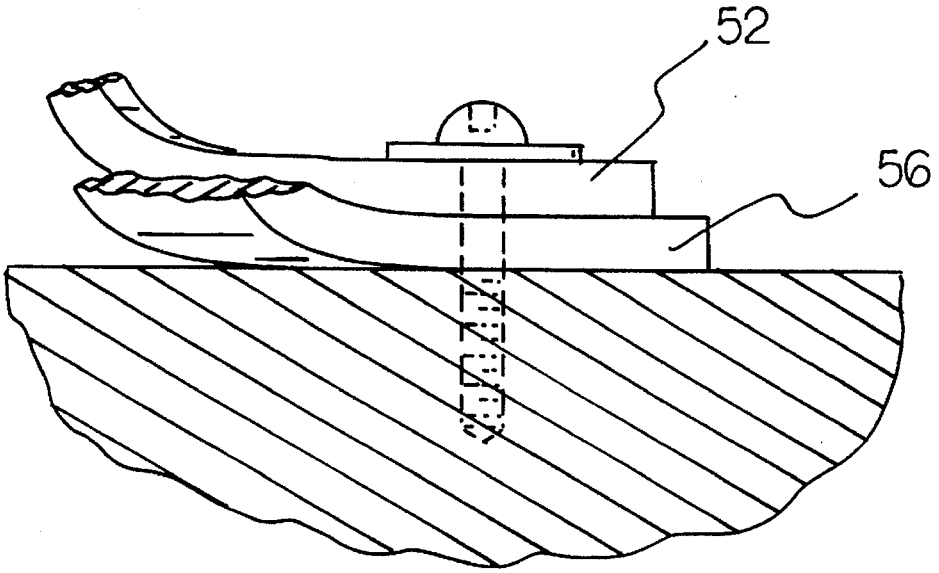
FIG 6

FRUSTROCONICAL EXERCISING DEVICE

BACKGROUND OF THE INVENTION

1. Field of the Invention

The present invention relates to a frustroconical exercising device and, more particularly, pertains to an exercising device with a frustroconical base.

2. Description of the Prior Art

The use of exercising and toning devices are known in the prior art. More specifically, exercising and toning devices heretofore devised and utilized for the purpose of exercising devices for exercising the abdominal muscles are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,752,067 to Colonello discloses an apparatus for use in exercising the abdominal muscles. U.S. Pat. No. 4,902,003 to Buoni illustrates an exercise device and an associated method. U.S. Pat. No. Des. 343,877 to Yin et al., discloses a multi-purposes physical exercising device. U.S. Pat. No. 4,979,732 to Rushatz et al., discloses a exercise and rehabilitative apparatus and method of using same. Lastly, U.S. Pat. No. 5,242,356 to Grenfell discloses an exercise and toning apparatus.

In this respect, the frustroconical exercising device according to the present invention substantially departs from the conventional concepts and designs of the prior art, and in so doing provides an apparatus primarily developed for the purpose of exercising device with a frustroconical base.

Therefore, it can be appreciated that there exists a continuing need for new and improved frustroconical exercising device which can be used for exercising device with a frustroconical base. In this regard, the present invention substantially fulfills this need.

SUMMARY OF THE INVENTION

In view of the foregoing disadvantages inherent in the known types of exercising and toning devices now present in the prior art, the present invention provides an improved frustroconical exercising device. As such, the general purpose of the present invention, which will be described subsequently in greater detail, is to provide a new and improved frustroconical exercising device apparatus and method which has all the advantages of the prior art and none of the disadvantages.

To attain this, the present invention essentially comprises a saucer for use in exercising various muscle groups, comprising, in combination, a frustroconical base. The base has a lower end of a first diameter, an upper end of an enlarged diameter and a tapering sidewall therebetween. A seating recess is formed within the upper end of the base. The upper end comprises an outer peripheral portion, an inner peripheral portion, a forward portion and a rearward portion. A first recessed pin has a first orientation positioned within the outer peripheral portion at the rearward portion. A second and a third recess pin of a second orientation is positioned within the outer peripheral portion at the forward portion of the upper end of the base. A first strap has an end secured adjacent to the first recessed pin and has a length comprising a first portion of a hook-type fastener and a second portion of a pile-type fastener. The first strap is adapted to be threaded through the second recessed pin such that the first portion of the strap comes into contact with the second portion of the strap. A second strap has an end secured at the outer peripheral portion of the rearward portion of the upper end of the base at a location opposite from the first recessed pin. The second strap has a first portion of a hook-type fastener and a second portion of a pile-type fastener. The second strap is adapted to be threaded through the first recessed pin such that the first portion of the second strap comes into contact with the second portion of the second strap. A third strap has an end secured over the end of the second strap. The third strap has a first portion of a hook-type fastener and a second portion of a pile-type fastener. The third strap is adapted to be threaded through the third recessed pin such that the first portion of the third strap comes into contact with the second portion of the third strap. A seat cushion is disposed within the seating recess formed within the upper end of the base.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved frustroconical exercising device which has all the advantages of the prior art exercising and toning devices and none of the disadvantages.

It is another object of the present invention to provide a new and improved frustroconical exercising device which may be easily and efficiently manufactured and marketed.

It is a further object of the present invention to provide a new and improved frustroconical exercising device which is of a durable and reliable construction.

An even further object of the present invention is to provide a new and improved frustroconical exercising device which is susceptible of a low cost of manufacture with regard to both materials and labor, and which accordingly is then susceptible of low prices of sale to the consuming public, thereby making such exercising and toning devices economically available to the buying public.

Still yet another object of the present invention is to provide a new and improved frustroconical exercising device which provides in the apparatuses and methods of the prior art some of the advantages thereof, while simultaneously overcoming some of the disadvantages normally associated therewith.

Still another object of the present invention is to exercising device with a frustroconical base.

Lastly, it is an object of the present invention to provide a saucer which is adapted to be used in exercising various muscle groups. The saucer includes a frustroconical base having a lower end of a first diameter and an upper end of an enlarged diameter. A number of straps are employed on the upper surface of the frustroconical base for use in securing a user thereon. Thus, with a user secured to the upper surface of the frusroconical base, they may shift their weight in such a manner that the device no longer rests on the lower surface of the base, and thus rests upon the tapered sidewall. The user can then commence various exercising routines in an effort to exercise difficult to reach muscle groups.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the frustroconical exercising device constructed in accordance with the principles of the present invention.

FIG. 2 is a side view of the device in accordance with the present invention.

FIG. 5 is a view of one of the recessed pins in accordance with the present invention.

FIG. 6 is a view of the securement of straps 2 and 3.

Similar reference characters refer to similar parts throughout the several views of the drawings.

DESCRIPTION OF THE PREFERRED EMBODIMENT

Figure 3:
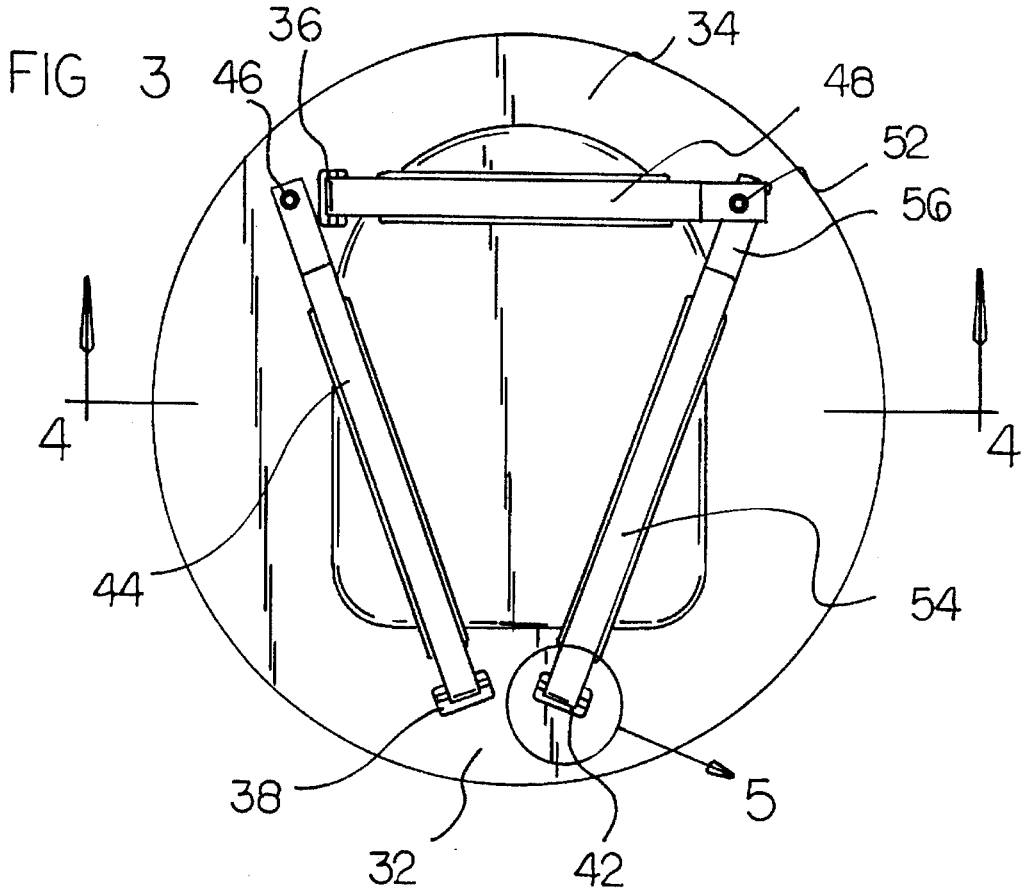
FIG. 3 is a plan view of the device in accordance with the present invention.
Figure 4:
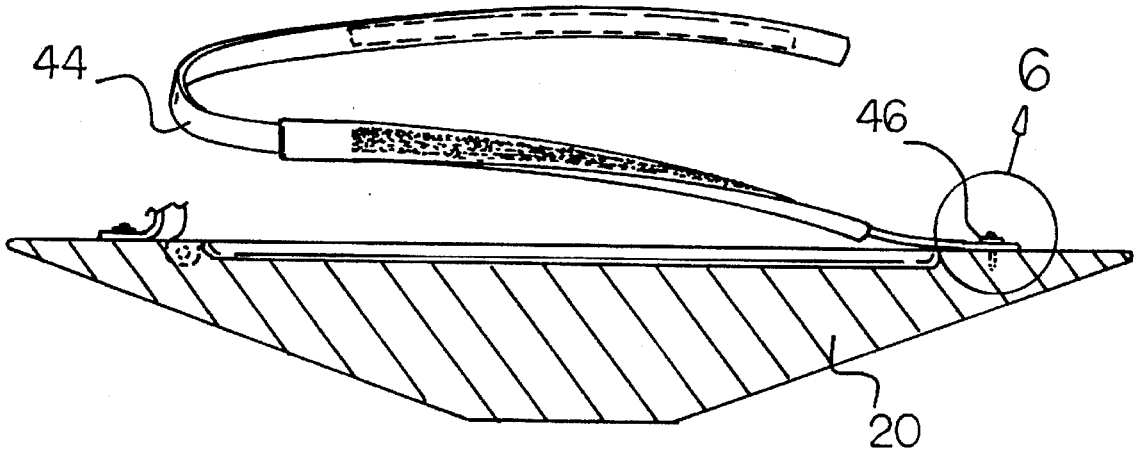
FIG. 4 is a view taken along line 4—4 of FIG. 3.

With reference now to the drawings, and in particular to FIG. 1 thereof, a new and improved frustroconical exercising device embodying the principles and concepts of the present invention and generally designated by the reference numeral 10 will be described.

The present invention relates to a saucer which is adapted to be used in exercising various muscle groups. The saucer includes a frustroconical base having a lower end of a first diameter and an upper end of an enlarged diameter. A number of straps are employed on the upper surface of the frustroconical base for use in securing a user thereon. Thus, with a user secured to the upper surface of the frusroconical base, they may shift their weight in such a manner that the device no longer rests on the lower surface of the base, and thus rests upon the tapered sidewall. The user can then commence various exercising routines in an effort to exercise difficult to reach muscle groups.

The various components of the present invention, in the manner in which they interrelate, will be described in greater detail hereinafter.

The device 10 of the present invention includes a frustroconical base 20. This base 20 is defined by a lower end 22 of a first diameter and an upper end 24 of an enlarged diameter as well as by a tapering sidewall 26 which extends therebetween. In the preferred embodiment, the lower end 22 has a diameter of 7 inches while the upper end 24 has a diameter of 35 inches. Furthermore, in the preferred embodiment, the overall height of the frustroconical base 20 is 5 inches. A seating recess 28 is formed within the upper end 24 of the base 20. This seating recess 28 is adapted to receive the seat of a user. Furthermore, the upper end 24 is defined by an outer peripheral portion, an inner peripheral portion, a forward portion 32 as well as a rearward portion 34.

In addition to the seating recess 28, a number of pins are also formed within the upper end 24 of the base 20. More specifically, a first recessed pin 36 has a first orientation and is positioned in the outer peripheral portion of the rearward portion of the upper end 24. Similarly, a second recessed pin 38 and a third recessed pin 42, each of which has a second orientation, are positioned within the outer peripheral portion at the forward portion of the upper end 24 of the base 20. The pins as well as their orientations, can most clearly be seen in FIG. 3. The function of these pins will be described in greater detail hereinafter.

In order to secure a user to the upper end 24 of the base 20, a number of straps are employed. Each of these straps has a end which is secured at the outer peripheral portion of the upper end 24 of the base 20. Furthermore, the first and second of these straps are specifically adapted to secure the legs of a user to the device 10. Similarly, the third strap is adapted to encircle the waist of a user. Additionally, each of these straps includes a first portion of a hook-type fastener and a second portion of a pile-type fastener such that the straps can be secured upon themselves. In other words, each strap has a first portion with a first Velcro™ fastener and a second portion with a mating second Velcro™ fastener. More specifically, the first strap 44 has an end 46 which is secured adjacent the first recessed pin 36. Furthermore, the first strap 44 has a length with a first portion of a hook-type fastener and a second portion of a pile-type fastener. This first strap 44 is adapted to be threaded through the second recessed pin 38. Thus, after the first strap 44 has been threaded through this pin, it can be folded back upon itself such that the first portion, the hook-type fastener, can come into contact with the second portion, the pile-type fastener, to thus fasten the first strap 44 back upon itself. This first strap 44 is adapted to secure one of the legs of a user to the upper end 24 of the base 20.

In a similar fashion, a second strap 48 has an end 52 which is secured at the outer peripheral portion of the rearward portion of the upper end 24. This securement takes place opposite the first recessed pin 36. The securement of the second strap 48 can most clearly be seen in FIG. 3. This second strap 48 has a first portion of a hook-type fastener and a second portion of a pile-type fastener. The second strap 48 is adapted to be threaded through the first recessed pin 36. Once threaded through the first recessed pin, the second strap can be folded back onto itself such that the first portion of the hook-type fastener comes into contact with the second portion of the pile-type fastener. This second strap 48 is adapted to secure the second leg of a user to the upper end 24 of the base 20.

The third strap 54 has an end 56 secured over the end of the second strap 48. The second strap 48 and the third strap each have an end which are secured at the same location. The third strap 54 has a first portion of a hook-type fastener and a second portion of a pile-type fastener. The third strap 54 is adapted to be threaded through the third recessed pin 42 such that the first portion of the hook-type fastener comes into contact with the second portion of the pile-type fastener. The third strap 54 is adapted to be secured about the waist of a user.

In order to provided comfort to a user, a seating cushion 58 can be disposed within the seating recess 28 formed within the upper end 24 of the base 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved saucer for use in exercising various muscle groups, comprising, in combination:

a frustroconical base having a lower end of a first diameter, an upper end of an enlarged diameter and a tapering sidewall therebetween, a seating recess formed within the upper end of the base, the upper end comprising an outer peripheral portion, an inner peripheral portion, a forward portion and a rearward portion;

a first recessed pin having a first orientation positioned within the outer peripheral portion at the rearward portion, a second and a third recess pin of a second orientation positioned within the outer peripheral portion at the forward portion of the upper end of the base;

a first strap having an end secured adjacent to the first recessed pin and having a length comprising a first portion of a hook fastener and a second portion of a pile fastener, the first strap adapted to be threaded through the second recessed pin such that the first portion of the strap comes into contact with the second portion of the strap;

a second strap having an end secured at the outer peripheral portion of the rearward portion of the upper end of the base at a location opposite from the first recessed pin, the second strap having a first portion of a hook fastener and a second portion of a pile fastener, the second strap adapted to be threaded through the first recessed pin such that the first portion of the second strap comes into contact with the second portion of the second strap;

a third strap having an end secured over the end of the second strap, the third strap having a first portion of a hook fastener and a second portion of a pile fastener, the third strap adapted to be threaded through the third recessed pin such that the first portion of the third strap comes into contact with the second portion of the third strap; and a seat cushion disposed within the seating recess formed within the upper end of the base.

* * * * *